US006349583B1

(12) United States Patent
Kleinschmidt et al.

(10) Patent No.: US 6,349,583 B1
(45) Date of Patent: Feb. 26, 2002

(54) METHOD AND DEVICE FOR FORMING A HOLLOW METALLIC WORKPIECE BY INNER PRESSURE

(75) Inventors: Jürgen Kleinschmidt, Beverungen; Dieter Töpker, Paderborn; Elmar Grussmann, Altenbeken, all of (DE)

(73) Assignee: Benteler AG, Paderborn (DE)

( * ) Notice: Subject to any disclaimer, the term of this patent is extended or adjusted under 35 U.S.C. 154(b) by 0 days.

(21) Appl. No.: 09/651,349

(22) Filed: Aug. 29, 2000

(51) Int. Cl.[7] ..... B21D 9/18

(52) U.S. Cl. ..... 72/62; 72/342.7; 72/342.97; 29/421.1

(58) Field of Search ..... 72/57, 58, 61, 72/62, 342.7, 342.1, 342.97; 29/421.1

(56) References Cited

U.S. PATENT DOCUMENTS

| | | | | | |
|---|---|---|---|---|---|
| 3,896,648 | A | * | 7/1975 | Schertenleib | 72/61 |
| 4,774,826 | A | * | 10/1988 | Hann | 72/54 |
| 5,214,948 | A | * | 6/1993 | Sanders et al. | 72/58 |
| 5,765,420 | A | * | 6/1998 | Schaefer | 72/58 |
| 5,960,658 | A | * | 10/1999 | Hudson et al. | 72/61 |
| 5,992,197 | A | * | 11/1999 | Freeman et al. | 72/62 |
| 6,067,831 | A | * | 5/2000 | Amborn et al. | 72/58 |
| 6,081,982 | A | * | 7/2000 | Schultz | 72/61 |
| 6,202,460 | B1 | * | 3/2001 | Gardon | 72/58 |

FOREIGN PATENT DOCUMENTS

| | | |
|---|---|---|
| DE | 2941972 | 4/1981 |
| DE | 196 42 824 A1 | 4/1998 |

* cited by examiner

*Primary Examiner*—David Jones
(74) *Attorney, Agent, or Firm*—Friedrich Kueffner

(57) ABSTRACT

In a method of forming a hollow workpiece having open ends by inner pressure in a multi-part forming tool, the forming tool having a forming mold is heated and the workpiece is placed into the forming mold of the forming tool. Closing plugs are inserted into the open ends of the workpiece, wherein the closing plugs are components of closing cylinders, in order to seal off the open ends. The forming tool is closed. A heated pressure fluid is introduced into the hollow workpiece through at least one of the closing plugs, with the hollow workpiece having been heated and plasticized in the forming tool. The material of the hollow workpiece is pressed with the heated pressure fluid into the forming mold of the forming tool. The device for performing the method has a multi-part forming tool with a forming mold for the workpiece. Hydraulic closing cylinders with closing plugs are provided for sealing the open ends of the workpiece. The forming tool has a heating device for heating at least the forming mold. Heated pressure fluid is introduced into the workpiece through at least one of the closing plugs.

6 Claims, 1 Drawing Sheet

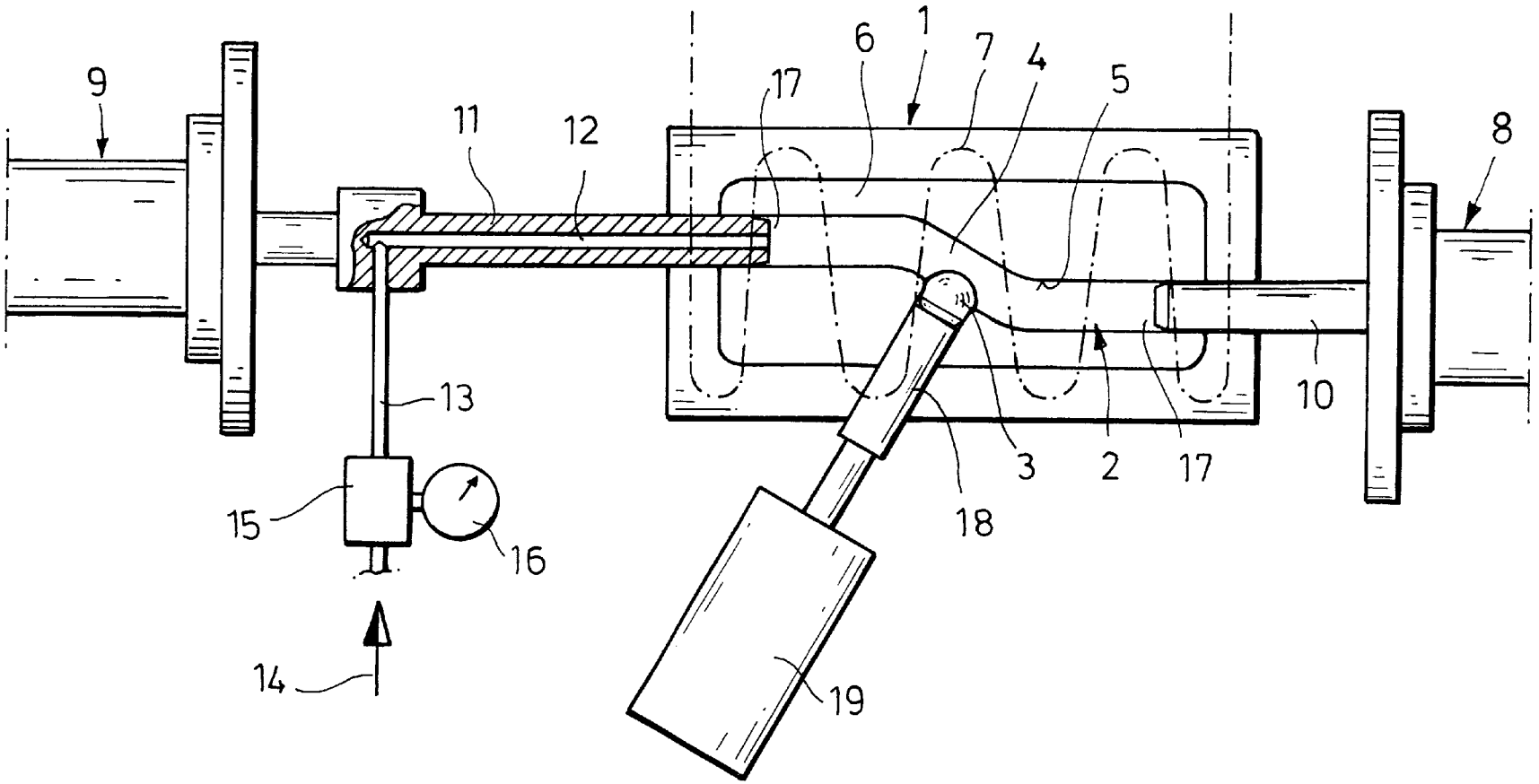
8
10
17
5
2
4
3
7
18
1
6
19
17
12
16
11
13
15
14
9

METHOD AND DEVICE FOR FORMING A HOLLOW METALLIC WORKPIECE BY INNER PRESSURE

BACKGROUND OF THE INVENTION

1. Field of the Invention

The invention relates to a method of forming a hollow, especially tubular, workpiece by inner pressure within a closed forming tool. Such a method is known in connection with the material steel as well as in connection with non-ferrous metals. The pressure fluid introduced into the workpiece is, in general, water or a water emulsion. The forming of the workpiece is carried out at room temperature.

2. Description of the Related Art

A disadvantage of the known prior art method is that the change in shape of the metallic materials in connection with complex forming steps is possible only with a high technical expenditure. Especially in the case of materials with a minimal plastic extension, for example, in the case of aluminum, several intermediate annealing steps are a necessity. Each intermediate annealing step, however, affects the metallic microstructure. Moreover, in the case of metallic materials such as aluminum, which do not undergo a microstructural transformation, the intermediate annealing entails the risk of making the material brittle. The proper function of the material during further practical use can therefore be significantly impacted.

From EP 0 785 036 A1 it is known to introduce hot sand into a workpiece and to then form the workpiece. In this context, the workpiece as well as the forming tool are heated before forming. During the forming step the temperature of the forming tool and of the workpiece is maintained.

However, the inner pressure forming by means of sand requires special handling. Small radii can be obtained only with considerable expenditure, if at all. Moreover, a one-sided forming, for example, forming a dome portion, can be performed only with difficulty. Also, there are considerable problems in regard to sealing as well as with respect to the service life of the forming tool. In principle, a high-quality standard for the inner surfaces cannot be achieved when using sand. This circumstance also results in an extremely high, cost-intensive expenditure which makes the economic efficiency of the known method questionable.

SUMMARY OF THE INVENTION

It is an object of the present invention to provide a method and a device for forming a hollow metallic workpiece by inner pressure with which a high inner and outer surface quality can be obtained with minimal inner pressures and forming forces and a considerably reduced apparatus expenditure.

In accordance with the present invention, this is achieved in connection with the method in that, for forming a hollow metallic workpiece having open ends by inner pressure in a forming mold of a multi-part forming tool, the workpiece is placed into the preheated open forming tool and, subsequently, closing plugs as components of the closing cylinders are sealingly inserted into the open ends and the forming tool is closed, whereupon a heated pressure fluid is introduced into the now heated and plasticized workpiece at least via one closing plug and the material of the workpiece is pressed into the forming mold in the forming tool under the effect of the pressure fluid.

It has been recognized with the invention that, by heating the workpiece to be formed and by heating the forming tool, a significant increase of the change in shape of the workpiece with simultaneous significant reduction of the forming forces can be achieved. For this purpose, the temperatures are expediently adjusted such that over the entire forming mold in the forming tool a uniform temperature profile is ensured. A further advantage of the invention is seen in that the closing forces for the forming tool as well as the closing forces at the ends of the workpiece can be significantly reduced. Also, the tool can be designed overall in a much simpler configuration.

The heating of the pressure fluid can be carried out outside of the forming tool. In general, however, the heating of the forming tool is sufficient in order to heat the pressure fluid to the required operating temperature when the pressure fluid is guided into the workpiece through corresponding channels provided in the forming tool.

The temperature which is required for facilitating forming of the workpiece can also be realized by heating the forming tool. An advantageous embodiment, especially for mass production, is realized in that the workpiece, before being placed into the forming tool, is heated to the expedient forming temperature.

The heating of the workpiece can be carried out in different ways. It is advantageous to heat the workpiece to the required temperature in a furnace external to the forming tool.

The forming process can be a simple widening of the workpiece in the closed forming tool or can be coupled with an additional movement of at least one of the closing plugs. This method is used especially in regard to complex configurations, for example, when over the length of the workpiece a lateral shaping in the form of a so-called dome is to generated and material must be pushed to this location. Moreover, the forming tool is provided with at least one further axially displaceable counter force in the form of a hydraulically actuated counter holding plunger in the area of this dome.

Even though the pressure fluid can be a weakly reactive oil, a gaseous pressure fluid whose chemical composition is adjusted such that no oxidation on the inner surface of the workpiece will result should be more expedient according to the invention. In this connection, the use of nitrogen as a pressure fluid is considered to be especially economically efficient. Nitrogen does not cause any chemical change of the material of the workpiece and also does not adhere to the inner surface of the workpiece. Furthermore, the pressure fluid nitrogen, especially in the form of pure nitrogen, which is inert in the temperature range in question, represents an especially advantageous embodiment.

Optionally, a mixed gas of nitrogen and argon or helium can be used.

According to a further method variant, the pressure fluid is pure air.

The desired plasticity of the workpiece for reducing the inner pressure in the workpiece as well as the forming forces is achieved in a temperature range of between 200° C. to 400° C. In this temperature range inner pressures of a magnitude of 150 bar to 500 bar are sufficient. Higher inner pressures can be used in this connection when the workpieces to be shaped have an especially great wall thickness.

Preferred is the forming of the workpiece in a temperature range between 250° C. and 350° C. The inner pressures preferred in this temperature range are then between 180 bar and 250 bar.

It is especially advantageous in the context of the invention when a workpiece made of aluminum or of an aluminum alloy is formed in accordance with the inventive method. This is so because in the case of aluminum the shape changing ability increases with increasing temperature to a certain degree before recrystallization occurs. At the same time, the plasticity limit is lowered to a smaller stress value. In this context, it is of special economic interest that an intermediate annealing of a workpiece made of aluminum can be completely eliminated, especially when a workpiece that is already at least partially formed is to be formed further. After a pre-forming step there is no need for maintaining the workpiece at the annealing temperature for several hours in order to return the material again to a plasticizable state.

In accordance with the present invention, the object of the invention with regard to the device is achieved in that the device, for forming a hollow metallic workpiece with open ends by inner pressure, comprises a multi-part forming tool with a forming mold for the workpiece and closing plugs, as a component of hydraulically actuatable closing cylinders, movable into the open ends, wherein the forming tool is heatable at least with respect to the forming mold and in which, via at least one of the closing plugs, a heated pressure fluid can be introduced into the optionally pre-heated workpiece.

Based on these features, the required forming forces can be lowered to such an extent that not only simple closing mechanisms for the forming tool and for closing the ends of the workpiece are sufficient, but, moreover, the forming tool overall can be configured in a much simpler way. Experiments have shown that the closing forces of the forming tool, in comparison to the forces which in the past were required for high pressures and room temperature forming, can be reduced by more than half. The reason for this is the comparatively minimal inner pressure required for forming the material of the workpiece, which is in a quasi plasticized state, according to the predetermined forming mold. Moreover, for the realization of complex contours on a pre-shaped hollow metallic workpiece, especially of aluminum or an aluminum alloy, the required axial pushing forces exerted via the closing plugs at the ends of the workpiece can be lowered significantly. In this context it is obvious that the adjustment of the parameters forming temperature, axial pushing force, and complexity of the workpiece must be adjusted to one another, while additionally taking into consideration the wall thicknesses and the inner diameter of the workpiece as well as the respective material. Overall, the forming tool can be produced in a more cost-efficient manner.

The pressure fluid may be pure nitrogen. However, conceivable is also a mixed gas of nitrogen and argon or helium. Moreover, it is conceivable that the pressure fluid is air.

The heating of the forming tool can be realized in different ways. It would seem to be advantageous to employ electrical heating. It is preferred to provide the forming tool with a capacitive or inductive electrical heating device.

BRIEF DESCRIPTION OF THE DRAWING

The only DRAWING shows schematically the forming tool according to the invention for forming a hollow metallic workpiece by inner pressure.

DESCRIPTION OF THE PREFERRED EMBODIMENTS

The only FIG. shows a forming tool 1 in a schematic illustration used for forming by inner pressure a hollow metallic workpiece 2, especially an aluminum pipe of AlMg3. The pre-formed, S-shaped workpiece 2 is to be provided with its final S-shaped contour, including a lateral dome 3 in the central transition portion 4, by means of the forming tool 1. For this purpose, the forming tool 1 is provided with a correspondingly shaped forming mold 5.

The forming tool 1 is provided with a heating device 7 in the illustrated lower die 6 as well as in the upper die (not shown). The heating device 7 is illustrated in the shown embodiment as an electrical heating coil.

At both end faces of the workpiece 2 the forming tool 1 is provided with hydraulically actuatable closing cylinders 8, 9 with axially movable closing plugs 10, 11. One of these closing plugs 10, 11, i.e., the closing plug 11, is provided with a longitudinal channel 12. An inlet line 13 for supplying a pressure fluid 14 is connected to the channel 12. The pressure fluid 14 is comprised of pure nitrogen. The inlet line 13 is provided with a control valve 15 with pressure gauge 16.

Both closing plugs 10, 11 are provided for sealing the ends 17 of the workpiece 2 as well as for introducing axial pushing forces if required for forming the dome 3.

For the purpose of forming the dome 3, a counter holding plunger 18, as a component of a hydraulically actuatable cylinder 19, is correlated with the forming tool 1.

When performing the inner pressure forming of the workpiece 2, the workpiece 2 is heated in a furnace, not shown, outside of the forming tool to a temperature between 250° C. and 350° C. parallel to the heating step for heating the forming mold 5 in the forming tool 1. The forming tool 1 has the same temperature as the workpiece.

The thus pre-heated workpiece 2 is then placed into the forming mold 5 and, subsequently, the closing plugs 10, 11 are introduced into the ends 17 of the workpiece 2 so as to seal them. The forming tool 1 can be closed simultaneously with the introduction of the closing plugs 10, 11 into the ends 17, but it can also be closed beforehand.

Subsequently, the pressure fluid 14 is introduced into the workpiece 2 in a pressure-controlled way via the inlet line 13, and this causes the plasticized material to be pressed into the forming mold 5.

The inner pressure required for this can be properly adjusted by means of the control valve 15 as a function of the respective pre-heating temperature of the workpiece 2 and the heating temperature of the forming tool 1.

The pressure fluid 14 can be heated before being supplied to the closing plug 11. Since, however, the closing plug 11 is also heated by the forming tool 1, the heat, which is transmitted from the forming tool 1 onto the closing plug 11 and from the closing plug 11 onto the pressure fluid 14 in the longitudinal channel 12, is sufficient to adjust the temperature level of the pressure fluid 14 to that of the workpiece 2 and of the forming tool 1.

While specific embodiments of the invention have been shown and described in detail to illustrate the inventive principles, it will be understood that the invention may be embodied otherwise without departing from such principles.

What is claimed is:

1. A method of forming a hollow workpiece having open ends by inner pressure in a multi-part forming tool, the method comprising the steps of:

heating a forming tool having a forming mold;

placing the workpiece of aluminum or an aluminum alloy into the forming mold of the forming tool;

inserting closing plugs into the open ends of the workpiece to seal off the open ends, wherein the closing plugs are components of closing cylinders, and closing the forming tool;

introducing nitrogen as a heated pressure fluid into the hollow workpiece through at least one of the closing plugs which has been heated via the forming tool, the hollow workpiece having been heated and plasticized;

pressing at a temperature of between 250° C. and 350° C. and at an inner pressure of between 180 bar and 250 bar the material of the hollow workpiece with the heated nitrogen into the forming mold of the forming tool; and adjusting the inner pressure by a control valve, provided in a supply line for the nitrogen, as a function of a heating temperature of the workpiece and the heating temperature of the forming tool.

2. The method according to claim 1, further comprising the step of heating the workpiece before the step of placing the workpiece into the forming mold.

3. The method according to claim 1, further comprising the step of heating the workpiece in a furnace before the step of placing the workpiece into the forming mold.

4. The method according to claim 1, wherein at least one of the closing plugs is moved into the workpiece in the step of introducing nitrogen.

5. A device for forming a hollow workpiece having open ends by inner pressure, the device comprising:

a multi-part forming tool with a forming mold configured to receive the workpiece of aluminum or an aluminum alloy;

hydraulic closing cylinders having closing plugs, wherein the closing plugs are configured to be inserted into the open ends of the workpiece received in the forming mold;

the forming tool having a heating device configured to heat at least the forming mold, wherein the closing plugs are heated via the forming tool;

wherein the heating device is a capacitive electric heater or an inductive electric heater;

wherein at least one of the closing plugs is configured to introduce nitrogen as a heated pressure fluid into the workpiece.

6. The method according to claim 1, wherein the nitrogen is heated externally before being introduced into the hollow workpiece.

* * * * *